US007954561B2

(12) United States Patent
Tulloch et al.

(10) Patent No.: US 7,954,561 B2
(45) Date of Patent: Jun. 7, 2011

(54) VERTICAL DIRECTION ADJUSTMENT TOOL FOR DOWNHOLE DRILLING APPARATUS

(75) Inventors: Rory McCrae Tulloch, Aberdeenshire (GB); Roger Farries Findlay, Aberdeenshire (GB); Allan Grant Clark, Aberdeenshire (GB); Victor Laing Allan, Aberdeenshire (GB)

(73) Assignee: Sondex PLC, Yateley, Hampshire (GB)

( * ) Notice: Subject to any disclaimer, the term of this patent is extended or adjusted under 35 U.S.C. 154(b) by 0 days.

(21) Appl. No.: 12/666,474

(22) PCT Filed: Jun. 20, 2008

(86) PCT No.: PCT/GB2008/050473

§ 371 (c)(1),
(2), (4) Date: Dec. 23, 2009

(87) PCT Pub. No.: WO2009/001123

PCT Pub. Date: Dec. 31, 2008

(65) Prior Publication Data

US 2010/0163311 A1 Jul. 1, 2010

(30) Foreign Application Priority Data

Jun. 27, 2007 (GB) ..... 0712451.4

(51) Int. Cl.
*E21B 7/10* (2006.01)
*E21B 7/08* (2006.01)
*E21B 7/06* (2006.01)

(52) U.S. Cl. ..... 175/76; 175/61; 175/62; 175/73; 175/79

(58) Field of Classification Search ..... 175/27, 175/61, 62, 73, 76, 79
See application file for complete search history.

(56) References Cited

U.S. PATENT DOCUMENTS

| | | | |
|---|---|---|---|
| 3,243,001 | A | 3/1966 | Vincent |
| 3,637,032 | A | 1/1972 | Jeter |
| 2006/0243487 | A1 | 11/2006 | Turner et al. |

FOREIGN PATENT DOCUMENTS

| | | | |
|---|---|---|---|
| EP | 0474459 | A2 | 3/1992 |
| WO | 2007109878 | A1 | 10/2007 |
| WO | 2007115397 | A1 | 10/2007 |

*Primary Examiner* — David J Bagnell
*Assistant Examiner* — Brad Harcourt
(74) *Attorney, Agent, or Firm* — Global Patent Operation; Mark A. Conklin

(57) ABSTRACT

A direction adjustment tool for a downhole drilling apparatus is disclosed. The tool has a tubular housing adapted to be incorporated into a downhole drilling apparatus, and steering blades mounted to the housing. A drive shaft transmits drive to a drill bit of a drilling apparatus, wherein the shaft defines a passage for transmitting drilling fluid to the drill bit. A first pressure chamber is defined between the housing and the shaft and communicates with the passage, wherein the steering blades are moved from retracted positions to extended positions thereof as a result of increase of fluid pressure the first pressure chamber. A pendulum member is pivotably mounted to extend in a vertical orientation when the shaft is not rotating relative to the housing, and pistons prevent movement of at least one steering blade to the extended position thereof as a result of the angle between a longitudinal axis of the shaft and the longitudinal axis of the pendulum member exceeding a predetermined amount. This causes at least one steering blade to adjust the direction of drilling of the drilling apparatus towards a vertical direction and/or to resist movement of the direction of drilling away from a vertical direction.

20 Claims, 10 Drawing Sheets

VERTICAL DIRECTION ADJUSTMENT TOOL FOR DOWNHOLE DRILLING APPARATUS

CROSS-REFERENCE TO RELATED APPLICATIONS

This is a national stage application under 35 U.S.C. §371(c) of prior-filed, co-pending PCT patent application serial number PCT/GB08/050473, filed on 20 Jun. 2008, which claims priority to GB patent application serial number 0712451.4, filed on 27 Jun. 2007, each of which is hereby incorporated herein by reference in its entirety.

BACKGROUND OF THE INVENTION

The present invention relates to a direction adjustment tool for a downhole drilling apparatus incorporating the tool, and relates particularly to a tool for correcting the direction of drilling of the drilling apparatus when it deviates from vertical. The invention relates particularly, but not exclusively, to such a tool for use in oil and gas well drilling apparatus.

Drilling direction adjustment tools are known for correcting the direction of drilling of a drilling apparatus incorporating the tool, and which include devices such as accelerometers or magnetometers, which provide an electrical signal representing the deviation of a longitudinal axis of the tool from the vertical. Electrical signals representing deviation of the longitudinal axis of the tool from the vertical are used to control the direction of drilling of the apparatus, for example by means of steering pushers which engage a wall of a borehole formed by the drilling apparatus, to cause the orientation of the tool to deviate, which in turn adjusts the direction of drilling back towards the vertical.

Existing tools of this type suffer from the drawback that the use of complicated electronic components increases the cost of production of the apparatus, and makes the apparatus more prone to failure. This can be particularly disadvantageous when the tool is located downhole, since drilling operations must be ceased while the tool is recovered.

BRIEF DESCRIPTION OF THE INVENTION

Preferred embodiments of the present invention seek to overcome the above disadvantages of the prior art.

According to the present invention, there is provided a direction adjustment tool for a downhole drilling apparatus, the tool comprising:

a tubular housing adapted to be incorporated into a downhole drilling apparatus;

a plurality of steering pushers slidably mounted to said housing, wherein each said steering pusher is moveable between a respective extended position in which said steering pusher engages a wall of a borehole formed by the drilling apparatus, and a respective retracted position, in which the steering pusher does not engage the wall of the borehole;

a hollow rotary shaft adapted to be incorporated into the drilling apparatus for transmitting drive to a drill bit of the drilling apparatus, wherein the shaft defines a passage for transmitting drilling fluid to the drill bit;

at least one first pressure chamber defined between said housing and said shaft and communicating with said passage, wherein at least one said steering pusher is adapted to be moved from the retracted position to the extended position thereof as a result of increase of fluid pressure in at least one respective said first pressure chamber;

a pendulum member pivotably mounted relative to the housing such that a longitudinal axis of the pendulum member extends in a substantially vertical direction when said shaft is not rotating relative to the housing and when a longitudinal axis of the shaft extends in a substantially vertical direction; and a control mechanism adapted to prevent movement of at least one said steering pusher to the extended position thereof as a result of the angle between the longitudinal axis of the shaft and the longitudinal axis of the pendulum member exceeding a predetermined amount, in order to cause at least one said steering pusher to adjust the direction of drilling of the drilling apparatus towards a substantially vertical direction and/or to resist movement of the direction of drilling away from a substantially vertical direction.

By providing a pendulum member pivotably mounted relative to the housing such that a longitudinal axis of the pendulum member extends in a substantially vertical direction when the shaft is not rotating relative to the housing and when a longitudinal axis of the shaft extends in a substantially vertical direction, and a control mechanism adapted to prevent movement of at least one said steering pusher to the extended position thereof as a result of the angle between a longitudinal axis of the shaft and the longitudinal axis of the pendulum member exceeding a predetermined amount, this provides the advantage of providing a drilling direction correction tool which can be constructed using mechanical components only. This avoids the use of complicated electronic components, which in turn reduces the cost of manufacture and servicing time and costs and increases the robustness and reliability of the tool.

In a preferred embodiment, the tool further comprises a plurality of second pressure chambers, wherein at least one said steering pusher is adapted to move from the retracted position to the extended position thereof as a result of increase of fluid pressure in at least one respective said second pressure chamber, and said control mechanism comprises a plurality of pistons, wherein each said piston communicates with at least one said first pressure chamber and at least one said second pressure chamber and has a first condition in which the piston does not engage the pendulum member and increase of fluid pressure in a said first pressure chamber communicating with said piston causes said piston to move relative to the housing to increase pressure in the or each second pressure chamber communicating with said piston to move the corresponding steering pusher to the extended position thereof, and a second condition in which the piston engages the pendulum member to limit movement of said piston relative to the housing to prevent movement of the corresponding steering pusher to the extended position thereof.

By providing a plurality of pistons, wherein each said piston communicates with said first pressure chamber and a said second pressure chamber and has a first condition in which the piston does not engage the pendulum member, and a second condition in which the piston engages the pendulum member to limit movement of said piston relative to the housing, this provides the advantage of enabling the control mechanism to be constructed in a simple mechanical manner, which in turn increases the robustness and reliability and reduces the cost of manufacture of the tool.

The sealing means may further comprise a plurality of sealing plates, wherein each said sealing plate is adapted to be mounted to the housing to at least partially define a respective said second pressure chamber.

This provides the advantage of simplifying assembly of the tool and minimising the risk of the sealing plates being damaged during assembly of the tool by avoiding the necessity of sliding an assembly defining all of the second pressure chambers along the bore of the tool. Also, this provides the advantage of allowing the steering pushers to be sealed off from one another without having to stagger their location along the length of the housing.

Each said sealing plate may have a compressible seal adapted to be compressed between a body of said sealing plate and said housing.

The tool may further comprise at least one aperture formed in said housing and at least partially defining a respective said second pressure chamber.

By forming at least one aperture in the housing at least partially defining a respective second pressure chamber, this provides the advantage of reducing the risk of leaks occurring in the vicinity of the sealing means, and of simplifying manufacture of the tool by reducing the number of components needed. This is particularly advantageous when the sealing means is subjected to significant back pressure, for example after air, has been evacuated from the second pressure chambers and then when being filled with oil, which is driven by a pump into the second pressure chamber under pressure.

In a preferred embodiment, when the angle between a longitudinal axis of the shaft and the longitudinal axis of the pendulum member does not exceed said predetermined amount, none of said pistons engages the pendulum member in use, and all of said steering pushers are able to move to the extended positions thereof.

The tool may further comprise sealing means adapted to be mounted to the housing to at least partially define at least one said second sealing chamber.

The sealing means may comprise at least one closure member having a plurality of closure surfaces adapted to at least partially define a plurality of respective second pressure chambers.

The sealing means may further comprise alignment means for assisting alignment of said sealing means relative to the housing.

This provides the advantage of assisting assembly of the tool.

The tool may further comprise a piston chamber block arranged between said housing and said shaft and defining a plurality of curved piston chambers for slidably receiving a respective curved portion of each said piston.

By providing curved piston chambers for receiving curved portions of the pistons, this provides the advantage of fully utilising the space occupied by the body of the piston chamber block between the housing and the shaft, which in turn reduces the axial depth of oil reservoir required. This in turn enables more robust pistons to be provided, while also reducing the difficulty of manufacturing and inspection thereafter, because the length over which the pistons and piston chambers must accurately match each other is reduced.

Each said piston chamber may communicate with a respective said second pressure chamber by means of a respective conduit formed in the housing.

This provides the advantage of further simplifying assembly of the tool.

The or each said second pressure chamber may contain oil.

Each said piston may include a respective first engaging portion for engaging a corresponding second engaging portion on said pendulum member.

Each said first engaging portion and/or said second engaging portion may define at least one respective inclined surface.

This provides the advantage of providing secure engagement between the pistons and the pendulum member, minimising the extent to which the pistons become inadvertently disengaged from the pendulum member even at elevated drilling fluid pressures, for example, due to drilling radial and axial vibrations.

Each said first engaging portion and/or said second engaging portion may define a plurality of respective inclined surfaces.

In a preferred embodiment, the pendulum member is pivotably mounted relative to the housing by means of a pivot adapted to move axially relative to said housing in response to increased fluid pressure in at least one said first pressure chamber.

This provides the advantage of maximising the length of overlap between the pistons and the pendulum member, which in turn maximises the sensitivity of the control mechanism to deviations of the tool from a substantially vertical orientation. This also provides the advantage of enabling the pendulum member to have a return stoke relative to the housing on removal of drilling fluid pressure in the first pressure chamber, to maximise reliability of engagement between the pistons and the pendulum member on subsequent increase of fluid pressure in the first pressure chamber.

The tool preferably further comprises first biasing means for urging said pendulum member axially relative to the housing towards said control mechanism.

This provides the advantage of maximising reliability of engagement between the pistons and the pendulum member on subsequent pressurisation of drilling fluid in the first pressure chamber.

The tool may further comprise at least one flow restrictor between the housing and the shaft and communicating with said first pressure chamber to restrict flow of drilling fluid therethrough to cause a pressure difference between the interior and the exterior of said first pressure chamber.

This provides the advantage of providing a more robust and lower cost alternative to a rotary seal for the first pressure chamber, and which can also act as a radial journal bearing.

The pendulum member may be pivotably mounted to at least one said flow restrictor.

This provides the advantage of minimising the number of components needed to construct the tool, which in turn improves the robustness and reliability of the tool.

Each said steering pusher may comprise a steering blade for contacting the wall of the borehole and mounted to the housing by means of at least one pusher piston communicating with a said second pressure chamber.

Each said pusher piston may be adapted to be removed from said housing from the exterior of the tool.

This provides the advantage of maximising the extent to which maintenance, adjustment and repair can be carried out at a drilling site.

The housing may be assembled from a plurality of parts.

This provides the advantage of reducing the cost of construction and maintenance of the tool by reducing the cost of the blade housing (or "housing") by making it as short as possible, which may need to be replaced due to wear and tear in use downhole.

The tool may further comprise at least one nozzle arranged in said passage.

This provides the advantage of enabling the pressure inside the bore of the tool to be increased for a given flow rate if the nozzles fitted in the drill-bit have large orifice diameters.

According to another aspect of the present invention, there is provided a downhole drilling apparatus including a direction adjustment tool as defined above.

The apparatus may further comprise at least one nozzle adapted to increase fluid pressure in said passage.

DESCRIPTION OF THE DRAWINGS

Preferred embodiments of the invention will now be described, by way of example only and not in any limitative sense, with reference to the accompanying drawings, in which.

DETAILED DESCRIPTION OF THE PREFERRED EMBODIMENTS

Figure 1:
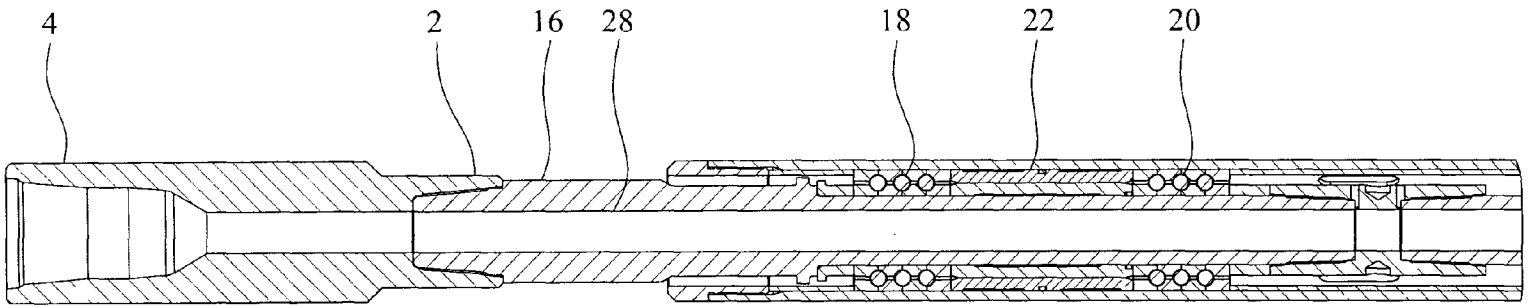
FIG. 1 is a cross sectional view of part of a first part of a vertical drilling tool of a first embodiment of the present invention.
Figure 5:
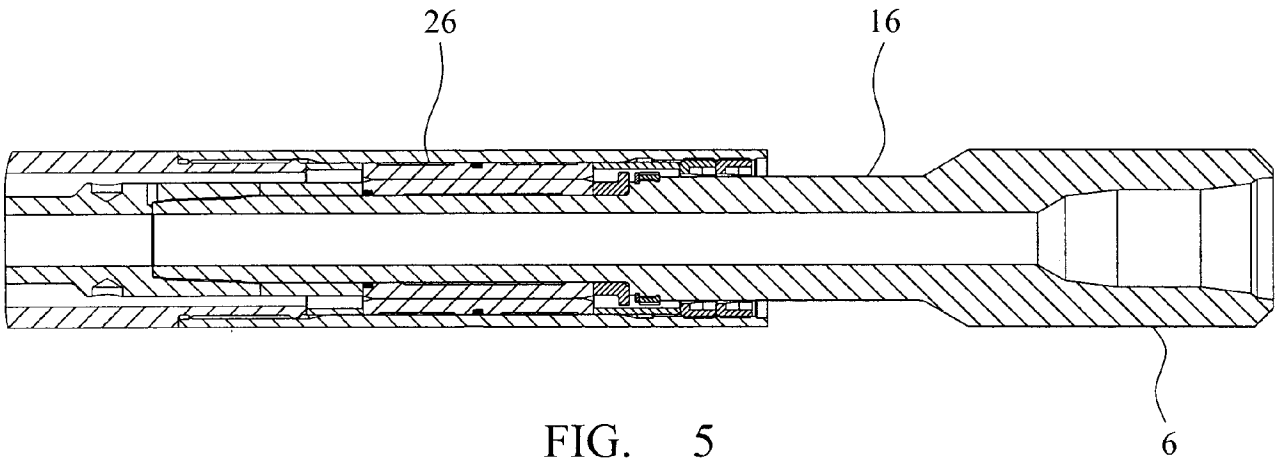
FIG. 5 is a cross sectional view of a fourth part of the tool of FIG. 1.

A vertical drilling tool 2 for incorporation into a drilling apparatus for drilling an oil or gas well has an upper end 4 (FIG. 1) for attachment to an upper part (not shown) of a drill string and a lower end 6 (FIG. 5) for attachment to a lower of the drill string. The tool 2 has a tubular housing 8 in which three steering blades 10 are slidably mounted by means of pusher pistons 12 such that the steering blades 10 are slideable relative to the housing 8 between a retracted position and an extended position in which the respective blade 10 engages the wall (not shown) of a borehole being formed by the drilling apparatus. Each of the blades 10 is adapted to be moved outwardly to its extended position by means of increased drilling fluid pressure, in a manner which will be described in greater detail below, and is urged inwardly relative to the housing 8 by means of a respective leaf spring 14.

A drive shaft 16 for transferring rotary drive from the surface to the drilling bit is rotatably mounted in the housing 8 by means of bearings 18, 20 and flow restrictor assemblies 22, 24, 26 and 66 (which also functions as a piston oil chamber block and radial bearing which can also have axial slots along the bore of the oil chamber at the right-hand end and so is not then a flow restrictor) and defines a hollow passage 28 for conveying drilling fluid along the bore of the tool to the drill bit (not shown). The drive shaft 16 is provided with a series of apertures 30 in its wall which communicate with a first pressure chamber 32 defined between the shaft 16 and the housing 8. Flow restrictor assembly 24 includes a flow restrictor member 34 slidably mounted to the shaft 16 and defining a flow restriction channel 36 between the flow restrictor member 34 and the drive shaft 16, such that when drilling fluid passes through apertures 30 into the first pressure chamber 32, the flow restrictor member 34 is urged to the left in FIG. 2 against the action of compression spring 38 abutting spring retainer 40, and controlled by engagement of pins 42 in corresponding axial slots 44 in the external surface of flow restrictor member 34. The spring retainer 40 is held in position by means of a circlip 46.

The flow restrictor assembly 24 operates such that when high pressure drilling fluid is located in the first pressure chamber 32, it flows through flow restriction channel 36 between the flow restrictor member 34 and the shaft 16, regardless of the axial position of the flow restrictor member 34 on the shaft 16, such that a pressure drop occurs between the interior of the first pressure chamber 32 and annular space 45 defined between the housing 8 and the shaft 16.

The flow restrictor member 34 cooperates with a flow restrictor nut 48 to define a part spherical internal surface 50 on both the flow restrictor member 34 and the flow restrictor nut 48 which engages a part spherical upper end 52 of a pendulum member 54 to enable pivoting of the pendulum member 54 through a small angle in any direction relative to the housing 8. The opposite end of pendulum member 54 defines a circumferential flange 56 defining a rearwardly inclined surface having a negative rake angle for engagement with corresponding engagement portions 58 on three pistons 60, the engagement portions 58 being located in the first pressure chamber 32.

Figures 7A, 7B:
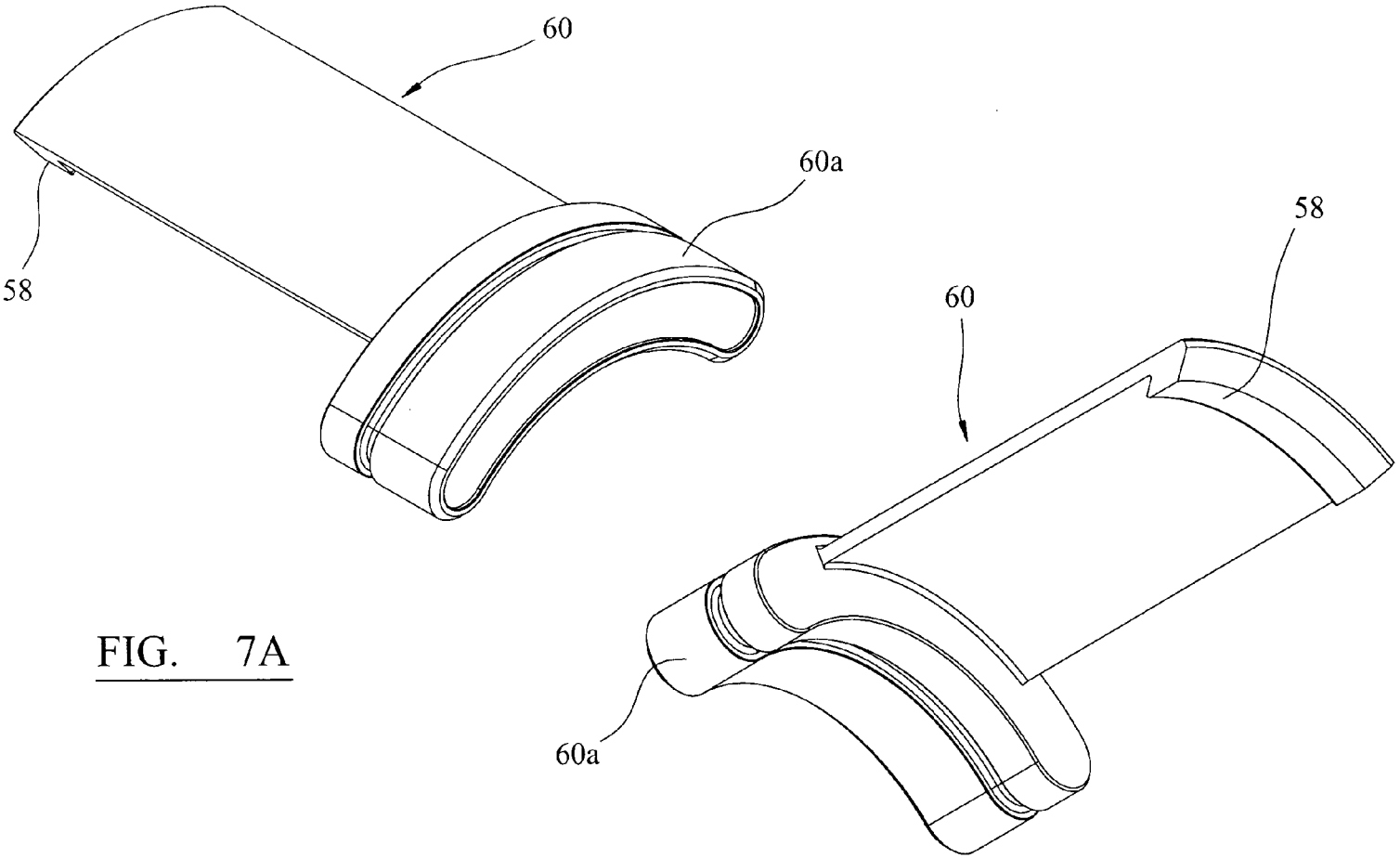
FIG. 7A is a perspective view of a piston of the tool of FIGS. 1 to 5 from one side.
FIG. 7B is a perspective view of the piston of FIG. 7A from the other side.
Figure 8B:
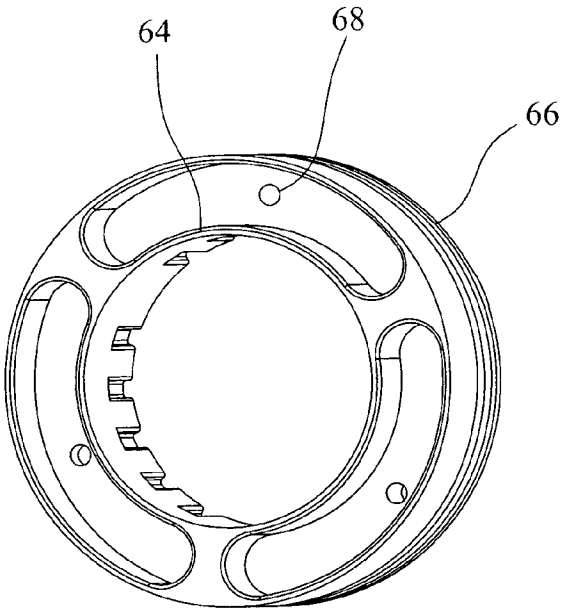
FIG. 8B is a perspective view of the piston oil chamber block of FIG. 8A from the other side.
Figure 8A:
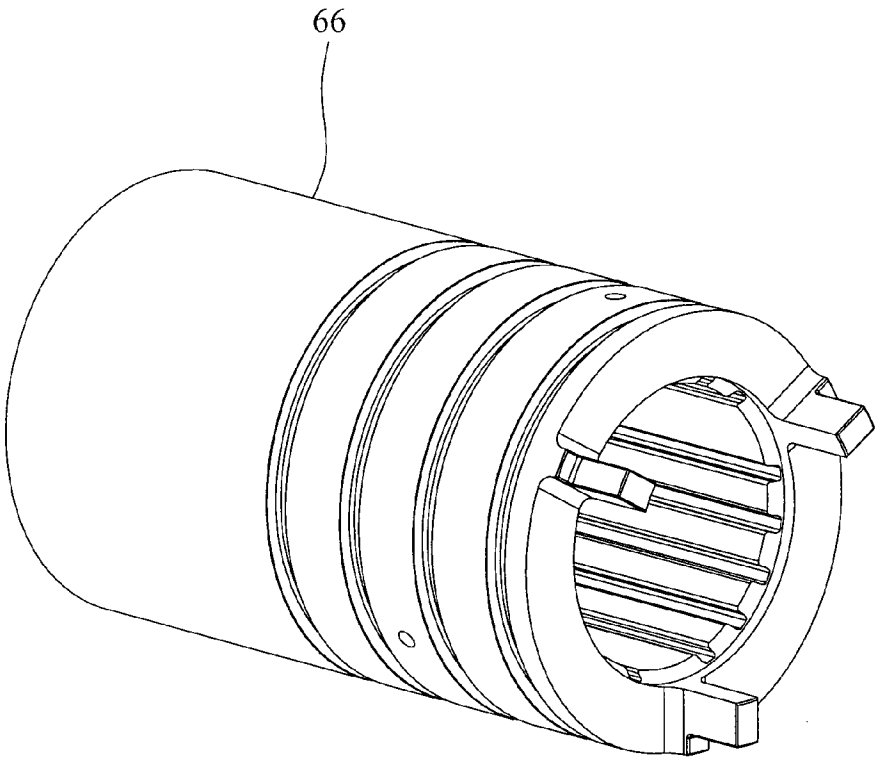
FIG. 8A is a perspective view of a piston oil chamber block of the tool of FIGS. 1 to 5 from one side.
Figure 9:
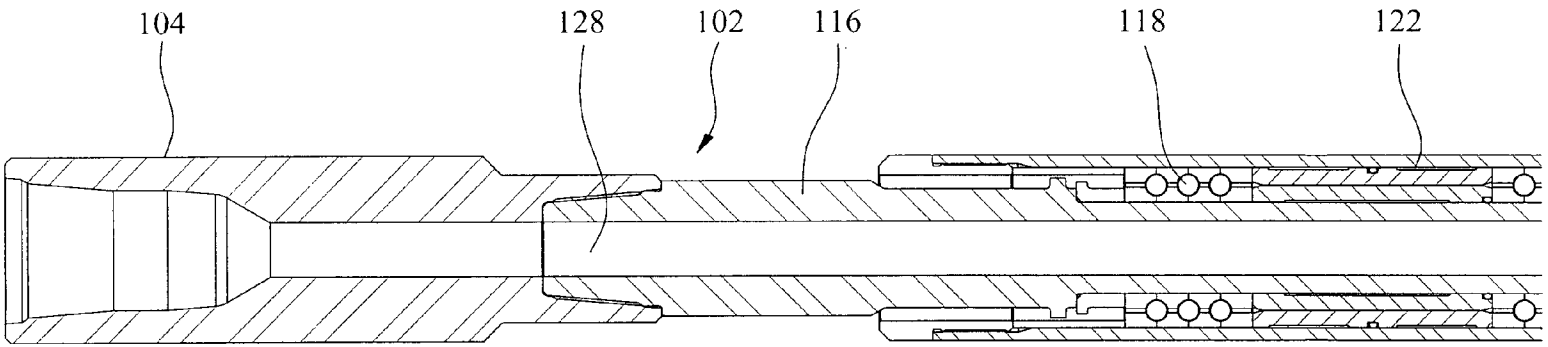
FIG. 9 is a cross sectional view of part of a first part of a vertical drilling tool of a second embodiment of the present invention.
Figure 10:
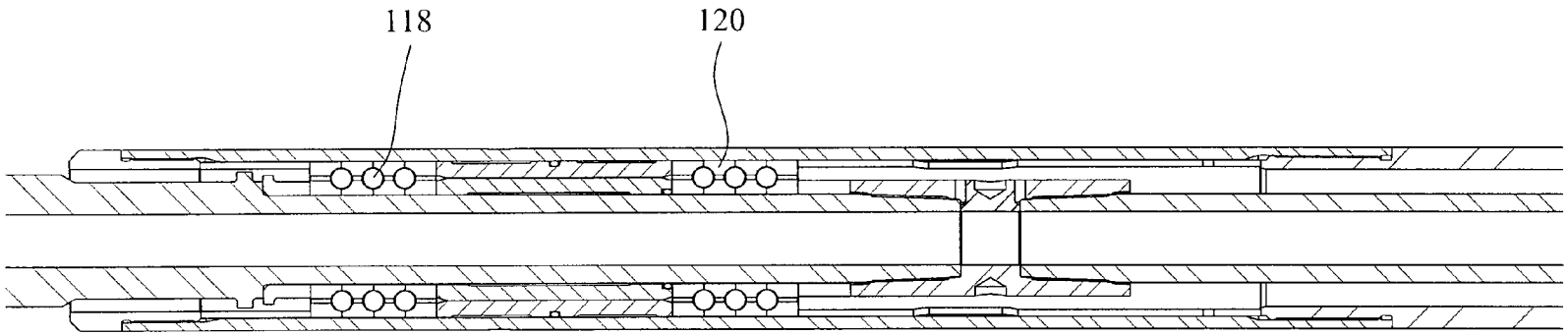
FIG. 10 is a cross sectional view of a second part of the tool of FIG. 9.
Figure 11:
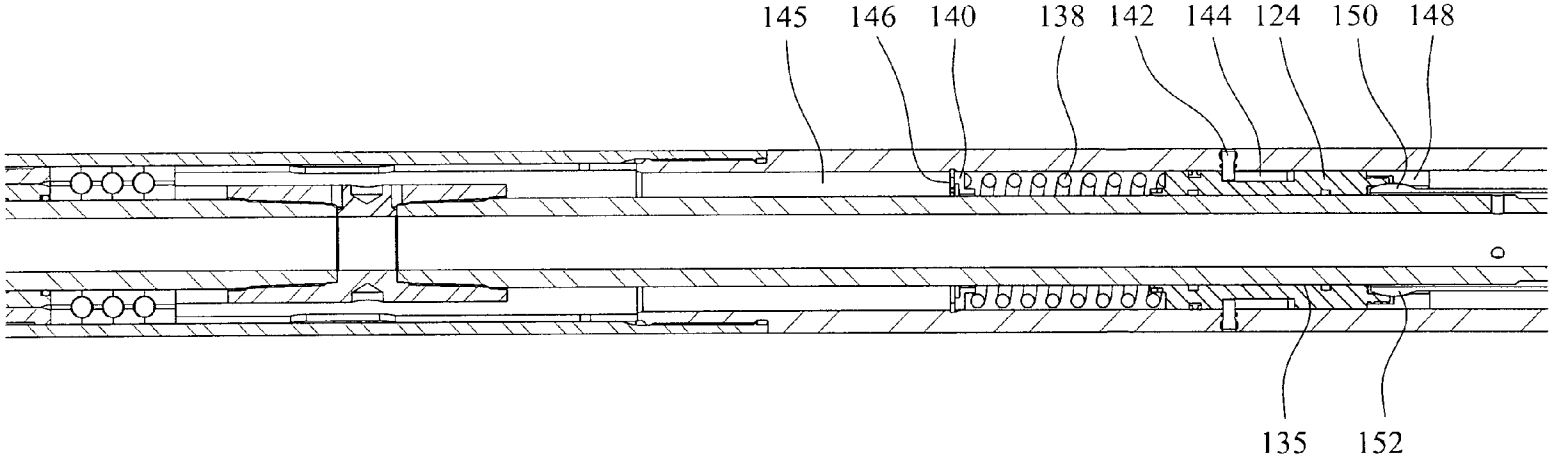
FIG. 11 is a cross sectional view of a third part of the tool of FIG. 9.

As shown in greater detail in FIGS. 7A and 7B, each of the pistons 60 has a head 60*a* defining slightly less than 120 degrees of circular arc and is slidably mounted by means of a respective O-ring 62 or more preferably an elastomer seal with an external profile which is more resistant to the seal rolling in its groove when the piston travels axially, in a respective piston chamber 64 of a cylindrical piston chamber block/flow restrictor/radial bearing 66 shown in greater detail in FIGS. 8A and 8B and located between the housing 8 and the drive shaft 16. The piston chamber block/flow restrictor 66 defines three piston chambers 64, each of which is filled with oil and slidably receives a piston 60 and communicates via conduits 68, 70 with a respective second pressure chamber 72 defined between pusher pistons 12 and a respective sealing plate in the form of a seal pad 74 located between the housing 8 and the shaft 16.

Figure 6:
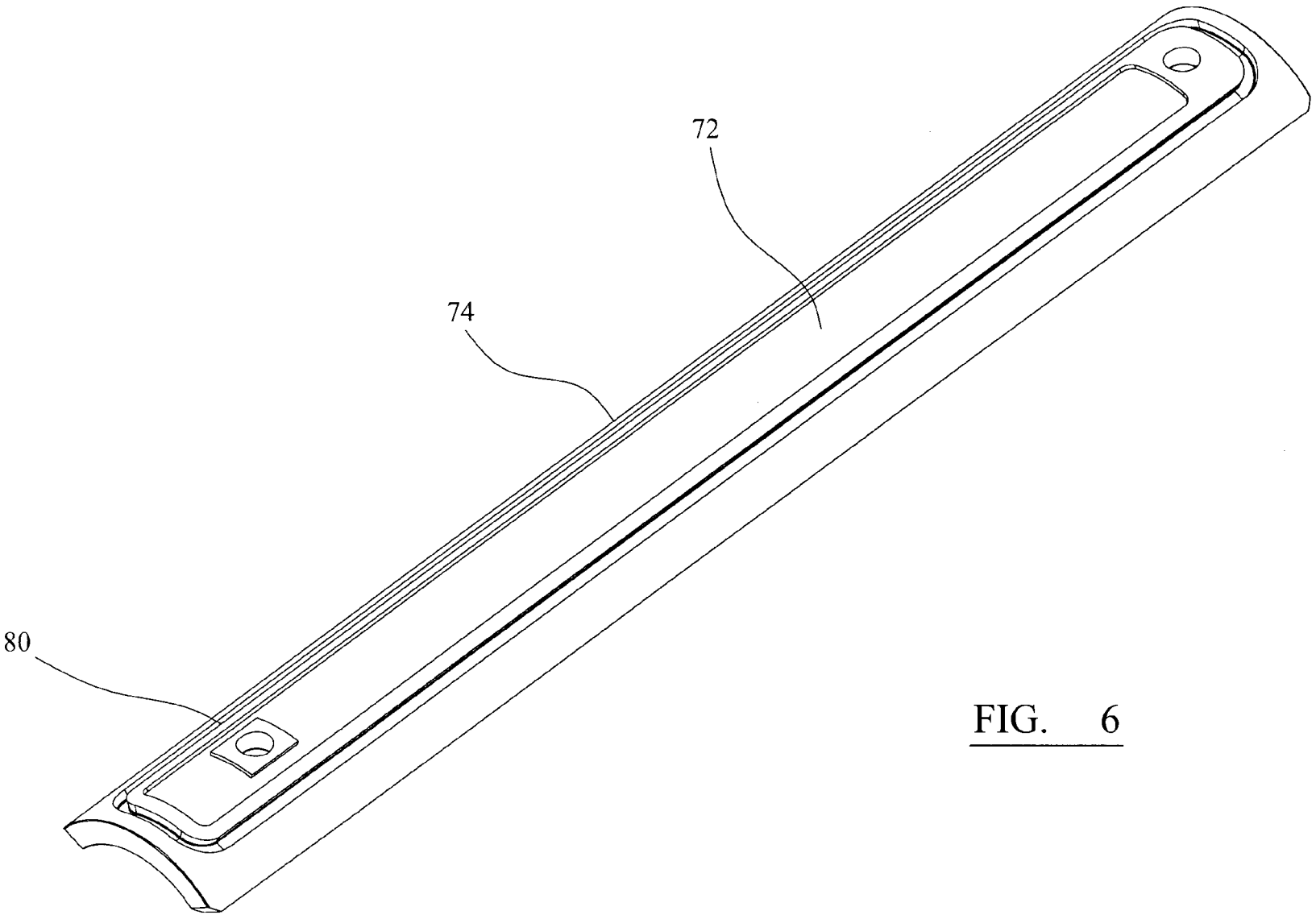
FIG. 6 is a perspective view of a sealing plate of the tool of FIGS. 1 to 5.

Three seal pads 74 are mounted to the housing 8 by means of screws 76, 78 such that each seal pad 74 and O-rings 80 define a respective oil-filled second pressure chamber 72 between the seal pad 74 and the pusher pistons 12, as shown more clearly in FIG. 6. Additional screws could also be added which are not shown to the centre of the seal pad to enhance the ability of the gasket seal around the periphery of the seal pad to seal properly in all instances of internal and external pressures applied to the oil-filled second chamber. Each second pressure chamber 72 communicates via conduits 68, 70 with a respective piston chamber 64 such that increase of pressure of drilling fluid in the first pressure chamber 32 is communicated by pistons 60 to the second pressure chambers 72 to enable the corresponding steering blades 10 to be pushed outwards against the action of two leaf springs 14 which are located along both sides of the steering blade 10.

Figure 2:
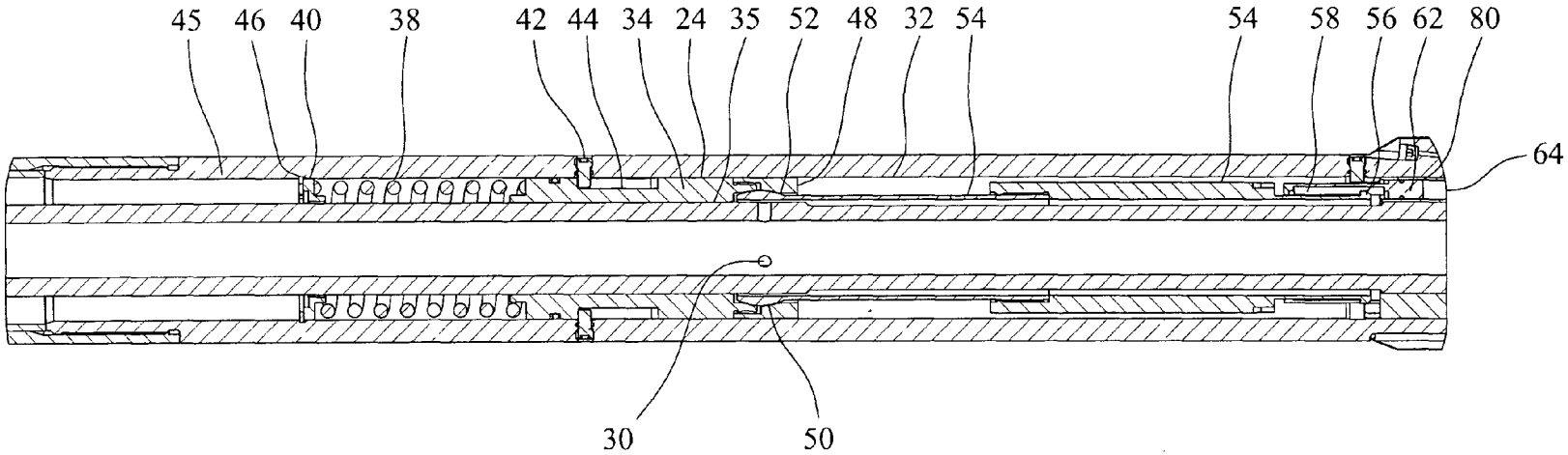
FIG. 2 is a cross sectional view of a second part of the tool of FIG. 1.
Figure 4:
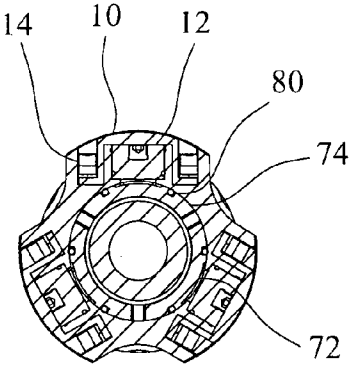
FIG. 4 is a cross sectional view along the line IV-IV in FIG. 3.

Because three separate second pressure chambers 72 are provided, each steering blade 10 is only able to extend outwards of the housing 8 to its extended position to engage the wall of the borehole if the corresponding piston 60 is able to slide to a sufficient extent in the corresponding piston chamber 64. However, if the engaging portion 58 of any of the pistons 60 engages the corresponding engaging portion 56 of the pendulum member 54 as the pendulum member 54 moves to the left as shown in FIG. 2 and the pistons 60 move to the right as shown in FIG. 2, the piston 60 is prevented from moving to the right to a sufficient extent to cause the corresponding steering blade 10 to move outwards relative to the housing 8 into engagement with the borehole wall. Engagement of one or two of the pistons 60 with the pendulum member 54 occurs as a result of the angle between the longitudinal axis of the pendulum member 54 and the longitudinal axis of the piston chamber block/flow restrictor 66 being more than a threshold very small amount.

In the design variant shown in the Figures only 0.45 deg of offset from vertical is required for the pendulum member 54 to catch the piston 60 on the low side of the hole.

The operation of the tool 2 will now be described.

In order to correct any deviation of the drilling direction of the drilling apparatus incorporating the tool 2 from the vertical direction, or to maintain a substantially vertical drilling direction, pumping of drilling fluid along the bore of the shaft 16 is first ceased in order to reduce the pressure of drilling fluid in the shaft 16 and the first pressure chamber 32, down to the ambient static environment pressure. As a result, the flow restrictor member 34 and therefore the pendulum member 54 are urged to the right in FIG. 2 (i.e. downwards in the borehole) by means of the compression spring 38. Removal of drilling fluid pressure also causes the steering blades 10 to be urged inwardly relative to the housing 8 under the action of leaf springs 14, as a result of which pressure in the second pressure chambers 72 urges the pistons 60 to the left as shown in FIG. 2 so that the upper parts 58 of the pistons 60 overlap the lower part 56 of the pendulum member 54. At the same time, the pendulum member 54 pivots freely about part spherical surface 52 so that its longitudinal axis is aligned generally towards the vertical by gravity.

If the longitudinal axis of the housing 8 is also arranged at a vertical orientation of less than 0.45 deg inclination, in this design example, as the pressure of drilling fluid in the bore of the shaft 16, and therefore in the first pressure chamber 32, is increased, the flow restrictor member 34 and pendulum member 54 are urged to the left as shown in FIG. 2 and the pistons 60 are urged to the right, and none of the pistons 60 engage the flange 56 of the pendulum member 54. The pistons 60 can therefore slide to their full extent, as a result of which all of the steering blades 10 are urged outwards of the housing 8 to engage the borehole wall to maintain the vertical orientation of the tool 2.

If, on the other hand, the longitudinal axis of the housing 8 of the tool 2 is aligned a small angle clockwise as shown in FIG. 2 of the vertical direction, as the pendulum member 54 aligns itself in a generally vertical direction, the longitudinal axis of the pendulum member 54 will be arranged at a small angle (0.45 deg or so is possible) anticlockwise of the longitudinal axis of the housing 8. As the pressure of drilling fluid in the shaft 16 is gradually increased, the pressure increase is communicated via apertures 30 to the first pressure chamber 32, as a result of which the flow restrictor member 34 and pendulum member 54 are urged to the left 2 against the action of compression spring 38, and the pistons 60 are urged to the right.

Figure 3:
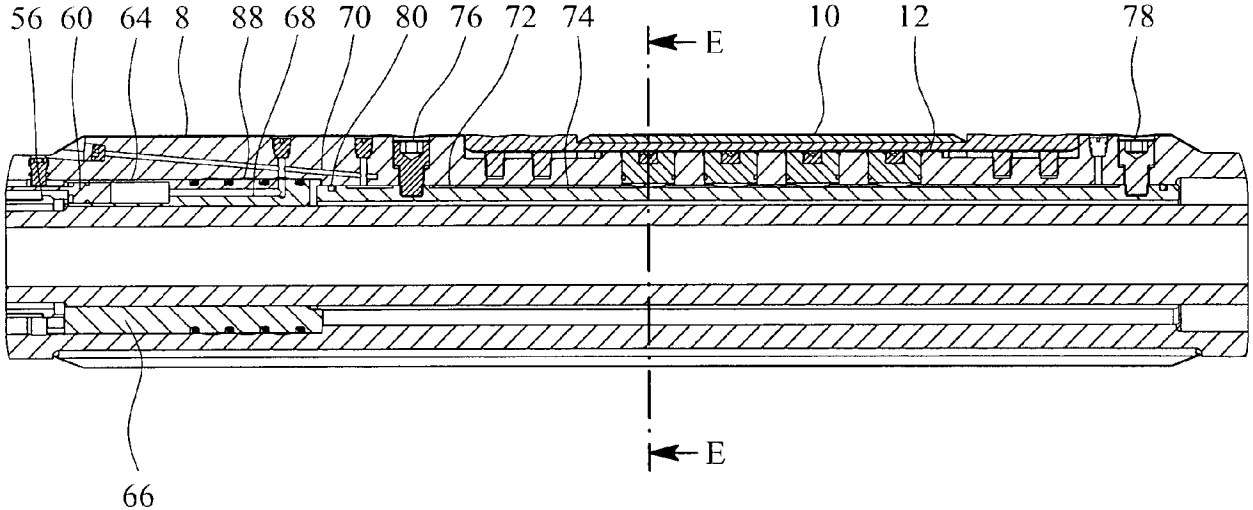
FIG. 3 is a cross sectional view of a third part of the tool of FIG. 1.

Because of the orientation of the pendulum member 54, the engaging portion 58 of one or two of the pistons 60 engages the flange 56 on the pendulum member 54 as a result of which further movement of the engaged piston 60 to the right as shown in FIG. 2 is prevented. This prevents the corresponding steering blades 10 from being urged outwardly of the housing 8 to engage the wall of the borehole. In the arrangement shown in FIGS. 2 and 3, the upper piston 60 shown in FIG. 2 engages the pendulum member 54 because the housing is oriented slightly clockwise of its intended position. The steering pusher 10 shown at the top of FIG. 3 is prevented from engaging the wall of the borehole, as a result of which the other two steering pushers blades (not shown) engage the borehole wall and urge the housing 8 in an anti-clockwise orientation, which therefore urges the tool 2 back towards a generally vertical orientation to correct deviation of the drilling direction away from the vertical.

Figure 12:
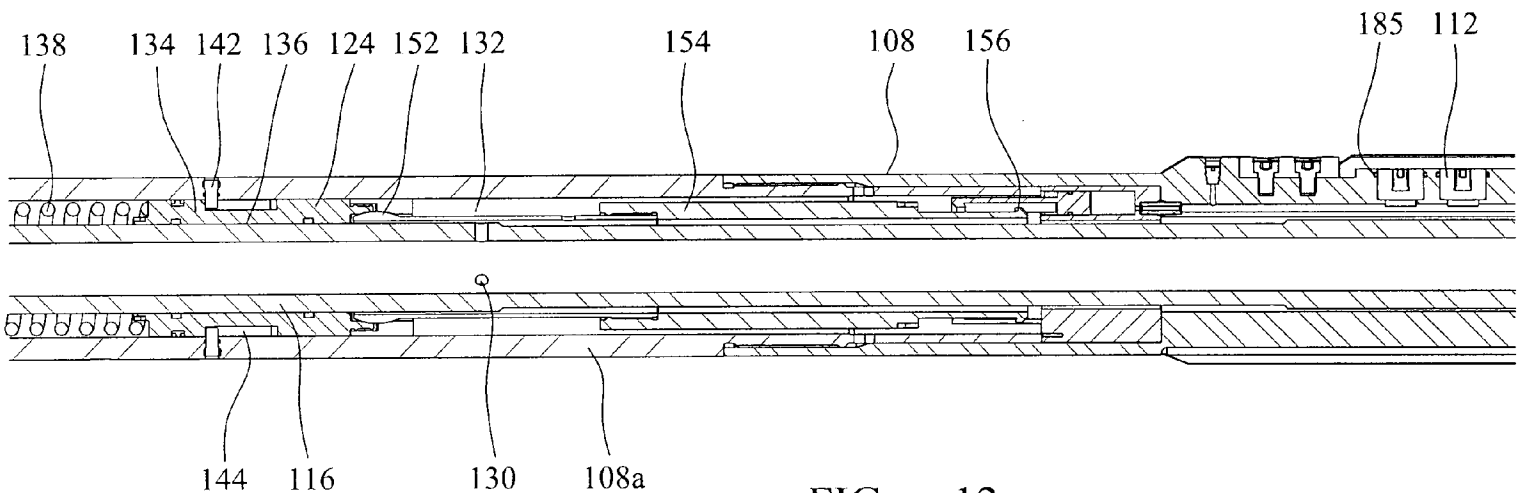
FIG. 12 is a cross sectional view of a fourth part of the tool of FIG. 9.
Figure 13:
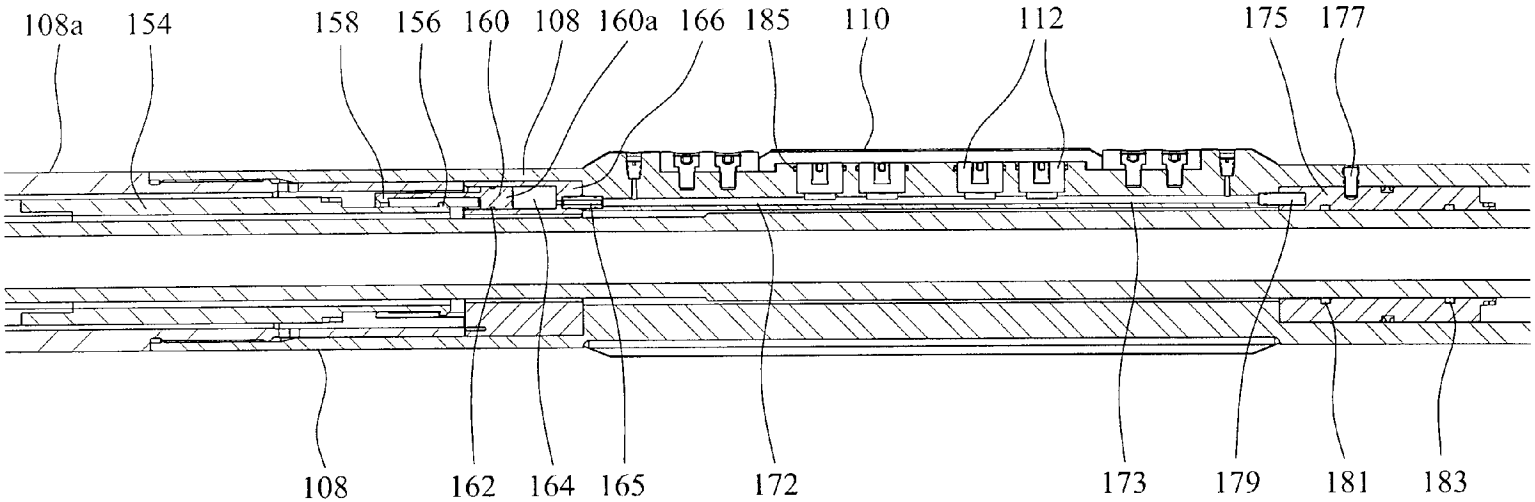
FIG. 13 is a cross sectional view of a fifth part of the tool of FIG. 9.

Referring to FIGS. 9 to 14, in which parts common to the embodiment of FIGS. 1 to 8 are denoted by like reference numerals but increased by 100, second pressure chambers 172 are defined by respective gun drilled holes 173 formed directly in the housing 108 of the tool, as shown in detail in FIG. 13. The gun drilled holes 173 are connected to the respective piston chambers 164, by means of hollow tubes 165 having longitudinal apertures in the ends of piston chamber block 166. As a result, the angled conduits 70 in the housing 8 of the embodiment of FIGS. 1 to 8 are no longer necessary. Similarly, the formation of the gun drilled holes 173 directly in the housing removes the need for seal pads, bolts, bolt gaskets seals and seal pad gasket O-rings of the embodiment of FIGS. 1 to 8, thus simplifying construction of the tool and reducing its cost and making the assembly less prone to leakage.

The lower part of the second pressure chambers is defined by a flow restrictor 175 located by means of three screws 177 in the housing 108, and which is mounted to the corresponding gun drilled holes 173 by means of three blanking plugs 179, in order to prevent the flow restrictor 175 from rotating with the central shaft 116 while the tool is in use in a drilling apparatus, and the screws 177 also prevent the flow restrictor 175 from sliding downwards as a result of gravity and/or vibration. Two grooves 181, 183 are provided on the internal surface of the flow restrictor 175. The first groove 181 is provided to locate an O-ring seal for pressure testing on assembly of the tool, and the second groove 183 enables the flow restrictor 175 to be pulled out of the blade housing 108 to enable the tool to be dismantled with an expandable wire puller service tool (not shown).

Compared with the embodiment of FIGS. 1 to 8, the piston chambers 164 and pistons 160 are wider and the chamber walls are provided with greater thickness, as a result of which the components become more robust and can withstand greater negative pressure which may occur in the piston chambers 164 as a result of the pistons 160 being caught by the pendulum 154 and pulled upwards as a result of movement of the flow restrictor 134. The piston chamber block 166 is also less expensive to manufacture and to replace when worn than the corresponding component of the embodiment of FIGS. 1 to 8.

As can be seen from FIGS. 12 and 13, the blade housing 108 is formed from two components (a lower component 108 and an upper component 108*a*), and has been made shorter, as a result of which it is of lower cost to replace when worn or damaged. Seals 185 on the pusher pistons 112 are located into the housing 108 and are not provided on the pistons 112, which enables the sliding surfaces of the pistons 112 to be coated with a hard corrosion resistant coating, such as HVOF tungsten carbide. This is easier to apply to the pusher pistons 112 than to the corresponding recesses on the housing 108 in which the pusher pistons 112 slide.

Figure 14:
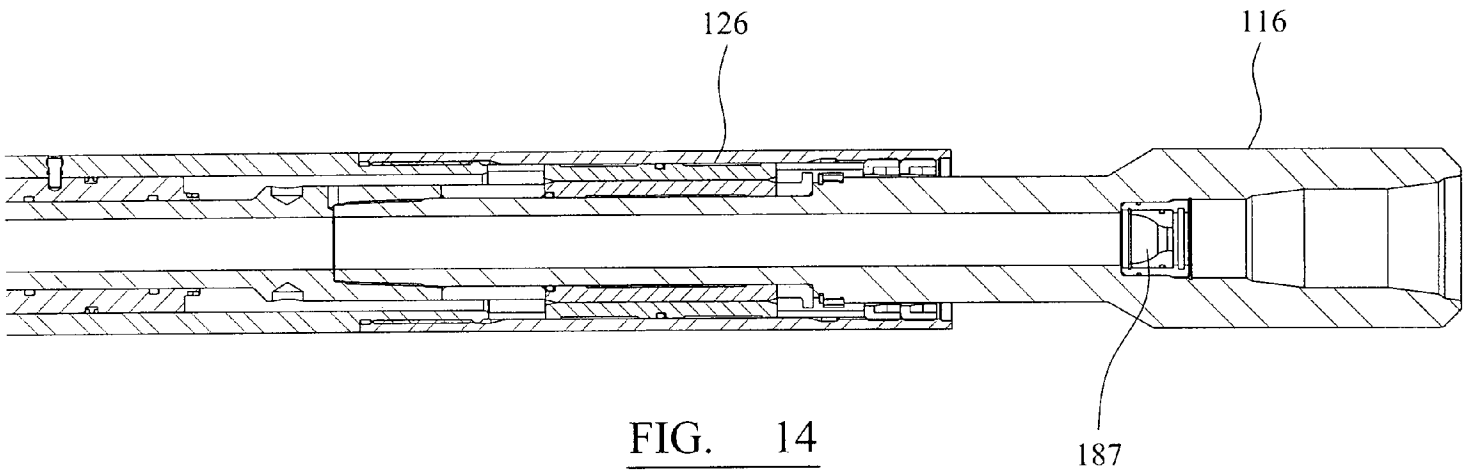
FIG. 14 is a cross sectional view of a sixth part of the tool of FIG. 9.

As shown in greater detail in FIG. 14, a nozzle 187 is provided in the output shaft 116. This enables the back pressure on the pusher pistons 112 to be increased if there is insufficient pressure drop across the drill bit during drilling. In addition, multiple thin longitudinal strips of hard facing (e.g. tungsten carbide) are provided on the outer surfaces of the blades 110, as a result of which the blades 110 are less likely to allow the blade housing to rotate as a result of rotation of the main drive shaft 116 assembly.

Figure 15:
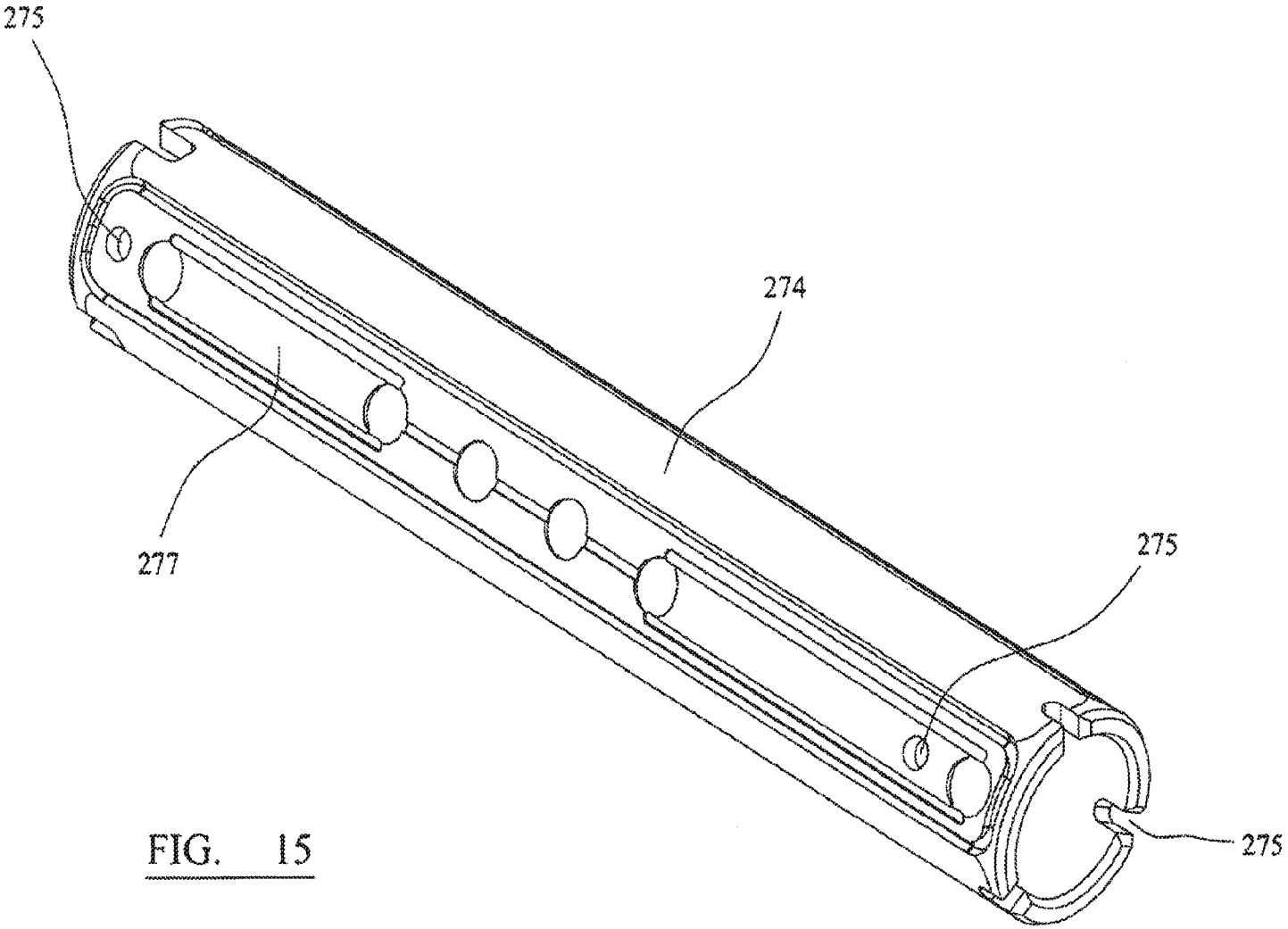
FIG. 15 is a perspective view of a sealing member of a third embodiment of the present invention.

Referring to FIG. 15, in which parts common to the embodiment of FIGS. 1 to 8 are denoted by like reference numerals but increased by 200, the seal pads 74 of the embodiment of FIGS. 1 to 8 are replaced by a single tubular sealing member 274, which provides greater stiffness than the case of three separate seal pads 74 of the embodiment of FIGS. 1 to 8. The tubular sealing member 274 is provided with three bolting points 275 at each of its ends in order to enable the sealing member 274 to be correctly located relative to the housing 108 of the tool. The sealing member 274 is located in position, and the second pressure chambers are defined by suitable recesses 277 in the sealing member 274, The second pressure chambers are sealed by means of suitable gasket O-rings (not shown) between the sealing member 274 and the internal surface of the housing 108 of the tool.

Figure 16:
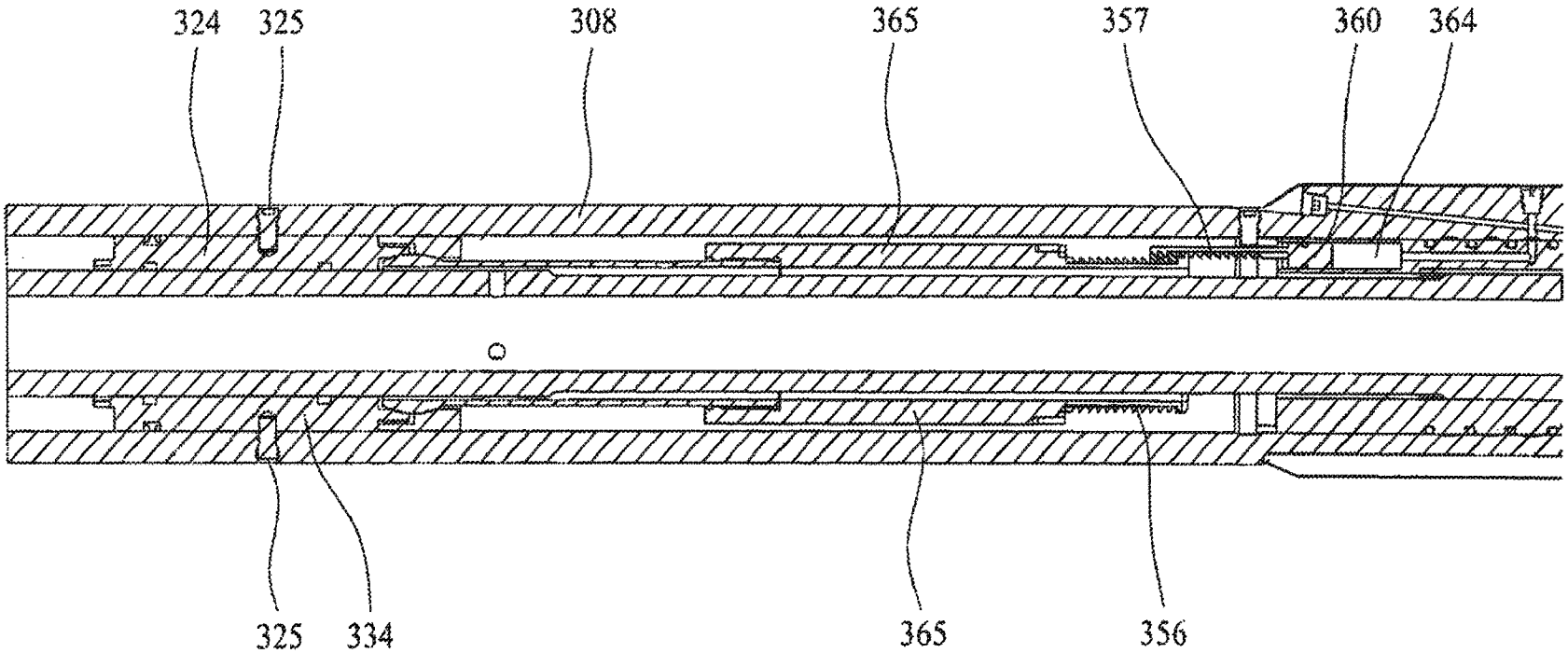
FIG. 16 is a cross sectional view of part of a tool of a fourth embodiment of the present invention.

Referring to FIG. 16, in which parts common to the embodiment of FIGS. 1 to 8 were denoted by like reference numerals but increased by 300, upper flow restrictor assembly 324 differs from the upper flow restrictor 24 of the embodiment of FIGS. 1 to 8 in that it is restrained by means of screws 325 from sliding axially in the housing 308. This provides the advantage that the walls of the piston chambers 364 are not exposed to significant negative pressures, since the flow restrictor member 334 is unable to forcibly pull the compensating pistons 360 against the direction in which they are pushed by the high internal pressure. The lower part of the pendulum member 354 is provided with a larger number of serrations 356 than the corresponding components of the embodiment of FIGS. 1 to 8, and the compensating pistons 360 are provided with corresponding serrations 357. As a result, this component has significantly greater strength than the corresponding component of the embodiment shown in FIGS. 1 to 8 as a result of the enlarged engagement area. In addition, the axial force passing through the mutually engaging parts of the pendulum 365 and the pistons 360 is lower because the seal area on the compensating pistons is lower than the seal area on the moving flow restrictor 34 of the embodiment of FIGS. 1 to 8.

It will be appreciated by the person skilled in the art that the above embodiment has been described by way of example only, and not in any limitative sense, and that various alterations and modifications are possible without departure from the scope of the invention as defined by the appended claims.

The invention claimed is:

1. A direction adjustment tool for a downhole drilling apparatus, the tool comprising:

a tubular housing adapted to be incorporated into a downhole drilling apparatus;

a plurality of steering pushers slidably mounted to said housing, wherein each said steering pusher is moveable between a respective extended position in which said steering pusher engages a wall of a borehole formed by the drilling apparatus, and a respective retracted position, in which the steering pusher does not engage the wall of the borehole;

a hollow rotary shaft adapted to be incorporated into the drilling apparatus for transmitting drive to a drill bit of the drilling apparatus, wherein the shaft defines a passage for transmitting drilling fluid to the drill bit;

at least one first pressure chamber defined between said housing and said shaft and communicating with said passage, wherein at least one said steering pusher is adapted to be moved from the retracted position to the extended position thereof as a result of increase of fluid pressure in at least one respective said first pressure chamber;

a pendulum member pivotably mounted relative to the housing such that a longitudinal axis of the pendulum member extends in a substantially vertical direction when said shaft is not rotating relative to the housing and when a longitudinal axis of the shaft extends in a substantially vertical direction;

a control mechanism adapted to prevent movement of at least one said steering pusher to the extended position thereof as a result of the angle between the longitudinal axis of the shaft and the longitudinal axis of the pendulum member exceeding a predetermined amount, in order to cause at least one said steering pusher to adjust the direction of drilling of the drilling apparatus towards a substantially vertical direction and/or to resist movement of the direction of drilling away from a substantially vertical direction; and a plurality of second pressure chambers, wherein at least one said steering pusher is adapted to move from the retracted position to the extended position thereof as a result of increase of fluid pressure in at least one respective said second pressure chamber, and said control mechanism comprises a plurality of pistons, wherein each said piston communicates with at least one said first pressure chamber and at least one said second pressure chamber and has a first condition in which the piston does not engage the pendulum member and increase of fluid pressure in a said first pressure chamber communicating with said piston causes said piston to move relative to the housing to increase pressure in the or each second pressure chamber communicating with said piston to move the corresponding steering pusher to the extended position thereof, and a second condition in which the piston engages the pendulum member to limit movement of said piston relative to the housing to prevent movement of the corresponding steering pusher to the extended position thereof.

2. A tool according to claim 1, wherein when the angle between a longitudinal axis of the shaft and the longitudinal axis of the pendulum member does not exceed said predetermined amount, none of said pistons engages the pendulum member in use, and all of said steering pushers are able to move to the extended positions thereof.

3. A tool according to claim 1, further comprising a piston chamber block arranged between said housing and said shaft and defining a plurality of piston chambers for slidably receiving a respective portion of each said piston.

4. A tool according to claim 3, wherein each said piston chamber communicates with a respective said second pressure chamber by means of a respective conduit formed in the housing.

5. A tool according to any one of claims 1 to 4, wherein each said piston includes a respective first engaging portion for engaging a corresponding second engaging portion on said pendulum member.

6. A tool according to claim 5, wherein each said first engaging portion and/or said second engaging portion defines at least one respective inclined surface.

7. A tool according to claim 6, wherein each said first engaging portion and/or said second engaging portion defines a plurality of respective inclined surfaces.

8. A tool according to claim 1, further comprising sealing means adapted to be mounted to the housing to at least partially define at least one said second sealing chamber.

9. A tool according to claim 8, wherein said sealing means comprises at least one closure member having a plurality of closure surfaces adapted to at least partially define a plurality of respective second pressure chambers.

10. A tool according to claim 9, wherein said sealing means further comprises alignment means for assisting alignment of said sealing means relative to the housing.

11. A tool according to claim 1, wherein said sealing means comprises a plurality of sealing plates, wherein each said sealing plate is adapted to be mounted to the housing to at least partially define a respective said second pressure chamber.

12. A tool according to claim 11, wherein each said sealing plate has a compressible seal adapted to be compressed between a body of said sealing plate and said housing.

13. A tool according to claim 1, further comprising at least one aperture formed in said housing and at least partially defining a respective said second pressure chamber.

14. A tool according to claim 1, wherein each said second pressure chamber contains oil.

15. A tool according to claim 1, wherein the pendulum member is pivotably mounted relative to the housing by means of a pivot adapted to move axially relative to said housing in response to increased fluid pressure in at least one said first pressure chamber.

16. A tool according to claim 15, further comprising first biasing means for urging said pendulum member axially relative to the housing towards said control mechanism.

17. A tool according to claim 1, further comprising at least one flow restrictor between the housing and the shaft and communicating with said first pressure chamber to restrict flow of drilling fluid therethrough to cause a pressure difference between the interior and the exterior of said first pressure chamber.

18. A tool according to claim 17, wherein the pendulum member is pivotably mounted to at least one said flow restrictor.

19. A tool according to claim 1, wherein each said steering pusher comprises a steering blade for contacting the wall of the borehole and mounted to the housing by means of at least one pusher piston communicating with a said second pressure chamber.

20. A tool according to claim 19, wherein each said pusher piston is adapted to be removed from said housing from the exterior of the tool.

* * * * *